US005756922A

United States Patent [19]

Fuller

[11] Patent Number: 5,756,922

[45] Date of Patent: May 26, 1998

[54] IMPROVEMENTS IN AND RELATING TO TEXTILE PRODUCTS

[75] Inventor: Martin P. Fuller, Leeds, United Kingdom

[73] Assignee: TBA Industrial Products Limited, United Kingdom; a part interest

[21] Appl. No.: 765,807

[22] PCT Filed: Jul. 19, 1995

[86] PCT No.: PCT/GB95/01708

§ 371 Date: Jan. 16, 1997

§ 102(e) Date: Jan. 16, 1997

[87] PCT Pub. No.: WO96/03613

PCT Pub. Date: Feb. 8, 1996

[30] Foreign Application Priority Data

Jul. 22, 1994 [GB] United Kingdom ..... 9414825

[51] Int. Cl.[6] ..... F41H 5/08

[52] U.S. Cl. ..... 89/36.02; 89/36.04; 89/36.08

[58] Field of Search ..... 89/36.02, 36.03, 89/306.07, 36.09, 30.01, 36.04, 36.08; 109/49.5; 160/135, 238

[56] References Cited

U.S. PATENT DOCUMENTS

| | | | |
|---|---|---|---|
| 1,418,995 | 6/1922 | Wallace | 89/36.02 |
| 2,666,840 | 1/1954 | Poirier | 160/238 |
| 3,491,847 | 1/1970 | Abbott | 180/82 |
| 3,774,958 | 11/1973 | Thorpe | 160/238 |
| 4,879,154 | 11/1989 | Bennett | 428/99 |
| 5,097,885 | 3/1992 | Kitagawa | 160/238 |
| 5,333,532 | 8/1994 | Smirlock et al. | 89/36.02 |
| 5,340,189 | 8/1994 | Goodman | 89/36.01 |
| 5,377,577 | 1/1995 | Bounkong et al. | 89/36.05 |
| 5,488,982 | 2/1996 | Rejc | 160/133 |

FOREIGN PATENT DOCUMENTS

| | | | |
|---|---|---|---|
| 67639 | 1/1915 | Austria | 89/36.09 |
| 6221796 | 8/1994 | Japan | 89/36.04 |
| 158281 | 2/1921 | United Kingdom . | |
| 2122319 | 1/1984 | United Kingdom . | |
| 2 202 890 A | 10/1988 | United Kingdom . | |
| 2 264 332 A | 8/1993 | United Kingdom . | |

*Primary Examiner*—Stephen M. Johnson
*Attorney, Agent, or Firm*—Nixon & Vanderhye P.C.

[57] ABSTRACT

A ballistic shield comprises a roll of ballistic blanket material having at one end thereof a device for attaching it at least temporarily to a structure so that the blanket may be unrolled to from a free hanging screen.

6 Claims, 3 Drawing Sheets

IMPROVEMENTS IN AND RELATING TO TEXTILE PRODUCTS

TECHNICAL FIELD

This invention relates to textile products and in particular to textile products useful in ballistic applications.

BACKGROUND

The construction of ballistic blankets is well known to those engaged in providing protection against ballistic threats. Typically such blankets comprise multiple layers of woven or non-woven para-aramid (KevlarTM, TwaronTM) or ultra-high molecular weight polyethylene (DyneemaTM, SpectraTM) fabric or combinations thereof, within a protection cover. Such ballistic blankets may be augmented by ceramic tiles—again well known in the field. Alternatively, ceramics, in the form of mosaic tiles or a loose fill of granular material, may form the bulk of the blanket. Metal components may also be used.

Protective clothing (body armour) is widely available. However, clothing made from ballistic blanket material is of limited utility in some circumstances. Flak jackets only cover the upper torso, leaving the head, arms and legs unprotected. Furthermore, police and other security personnel facing armed assailants in, for example, siege situations often have only fences, hedges or their vehicle(s). The only parts of a normal vehicle substantial enough to afford signification protection are the engine block and rear axle.

As rear axles are virtually obsolete and fences and hedges afford little or no ballistic protection, the only position offering reasonable protection in the absence of a substantial wall is behind the engine block—far from ideal for maintaining observation; even less so for returning fire. The problem is exacerbated if the assailant(s) is (are) at a higher level than the security personnel, e.g., in first or second storey windows. It will be appreciated that personnel even if wearing protective clothing will often be readily visible to an assailant hiding in a building.

SUMMARY OF THE INVENTION

According to the present invention, in its simplest form there is provided a portable ballistic shield constituted by a roll of ballistic blanket material having at one end thereof means for attaching it at least temporarily to a structure so that the blanket may be unrolled to form a free hanging screen. The means for attaching the blanket to a structure may be for example a magnet, suction cups, hooks, tapes or a weight, magnets being particularly preferred, although if a suitable base is provided, gravity may also be used.

Advantageously, the roll is provided with an integral case, the latter preferably including the means for attaching the shield to a structure. The case itself is not necessarily of a ballistic material, although according to a particularly preferred embodiment of the invention, it includes an upstand of a ballistic material, thereby providing additional protection as well as an improved degree of concealment.

It will be appreciated that references to a roll of ballistic blanket in the present context are to the shield in its pre-deployment state, because a particularly advantageous aspect of the invention is the ability to transport it easily and to deploy it extremely rapidly. To facilitate this, the case may include easy release fastenings, for example peel-apart, re-closable fabric tapes of the kind sold as VELCRO (TM), with at least one drop-down panel to facilitate unrolling the blanket. Conveniently, the base of the case includes the means for attaching the latter to a structure. The case preferably also includes a carrying handle.

Particularly preferred is an assembly in which the case for the shield contains a number of magnets for attaching the whole unit to a vehicle roof or other ferrous structure and includes an upright, (in use) ballistic panel, or screen, behind which personnel can operate in relatively safety. Such a screen may be constituted as a wall of the case and in its simplest form may comprise a semi-rigid, ballistic laminate, typically 0.15 to 0.3 m high. Possible enhancements might include hinged side panels, pockets for ceramic inserts or equipment storage, bullet-proof transparent screen with a firing slot and attachment points for ancillary equipment such as lights. The front face of the screen may be concave to facilitate the trapping of projectiles. Alternatively, a fibre-filled 'bolster' may be used to trap them.

Preferably the end of the blanket roll is not attached directly to the case but to the screen, a little way above the point at which it, itself is attached to the case. This has the effect of trapping any ricochets below the blanket. If the blanket is made detachable, for example by using a zip fastening, it can easily be removed for cleaning or repair or, in emergency, pressed into service as a stretcher—for which purpose handles may be provided. Alternatively, pockets to receive rigid poles may be provided so that the detached blanket can be adapted for use as a portable shield. Other detail features which may be used to enhance the overall performance of the system include a carrying strap mounted end-to-end of the case so that the inner panel of the case forms the bottom of the folded unit and attached immediately to a car roof, allowing the other half to drop rapidly into position. As previously mentioned, release of the other half may be by means of a linked, multi-way VELCRO (TM) fastening system so that only a single pull is required to release the full width of the fabric. The carrying strap may be in two parts, linked by a quick-release buckle. This facilitates use of the straps as alternative attachment means for securing the case to a wall, hedge or tree, for example.

Further aspects of the invention will be apparent from the following description of preferred embodiments, but on trial it has proved possible to deploy a shield according to the invention in as little as 2 or 3 seconds, the person effecting the deployment being protected (to a limited extent) both prior to and during deployment. Once deployed, the shield afforded the user both useful protection and concealment from direct attack.

In order that the invention be better understood, preferred embodiments of it will now be described by way of example with reference to the accompanying drawings.

DETAILED DESCRIPTION OF THE DRAWINGS

Figure 1:
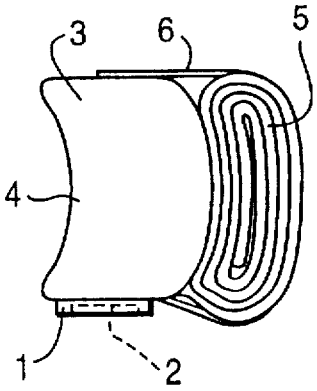
FIG. 1 is a diagrammatic side view of a shield assembly according to the invention, in its pre-deployment, or rolled-up state.

In the interests of clarity, like parts in all seven Figures will bear like reference numerals.

Figure 2:
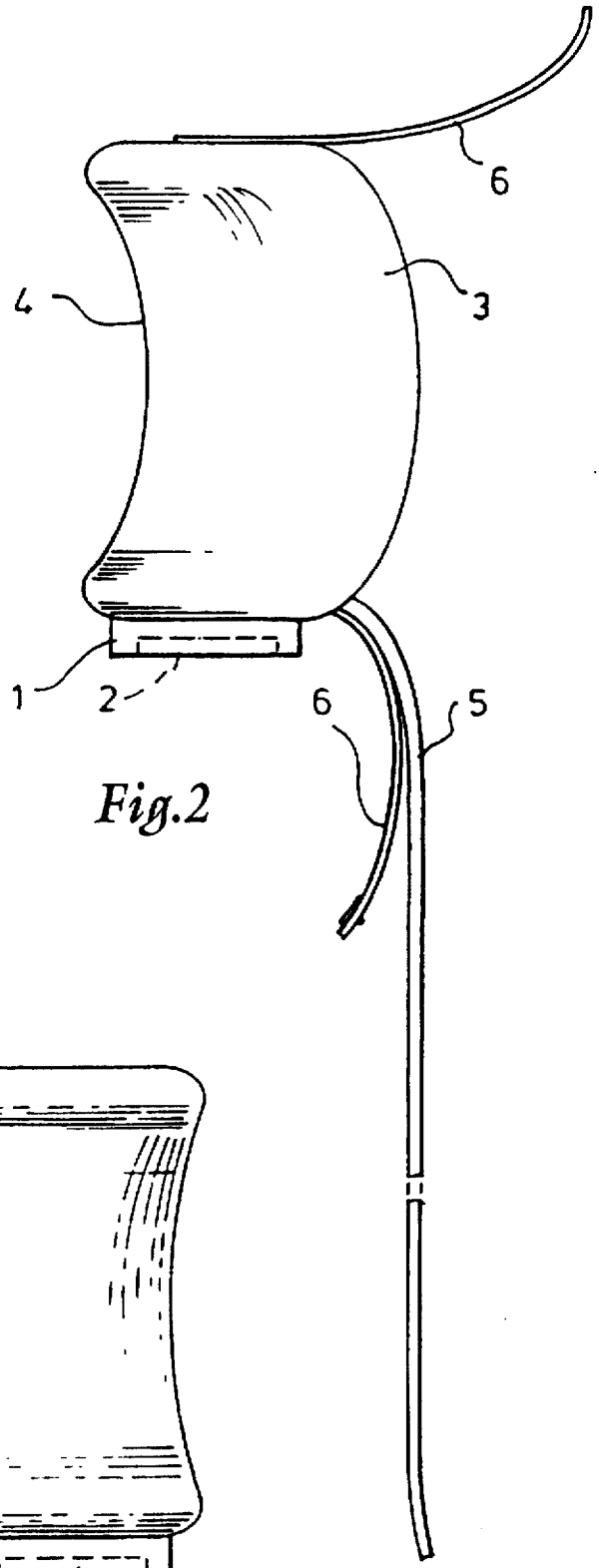
FIG. 2 is a larger scale view of the same shield as FIG. 1, but after deployment.
Figure 3:
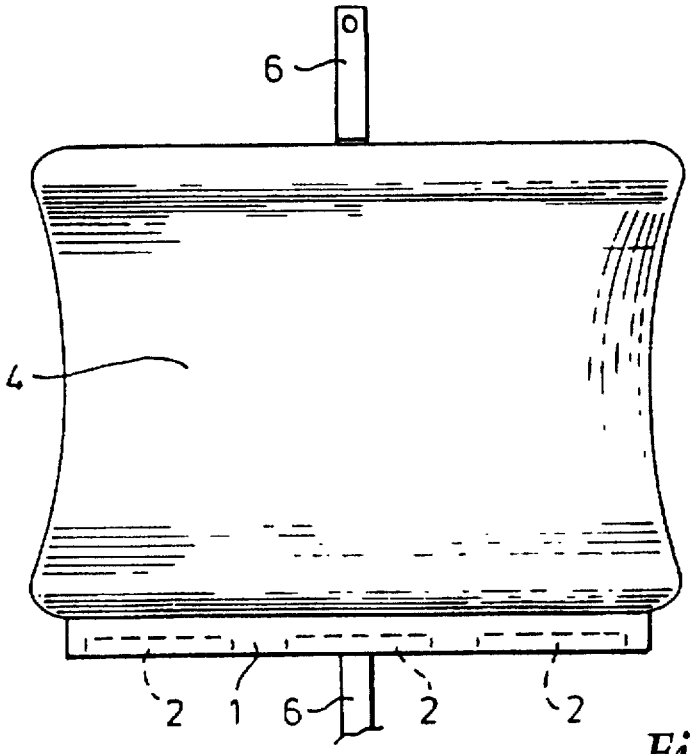
FIG. 3 is a view of the shield of FIGS. 1 and 2 as seen from the left (referring to the other Figures) by a potential assailant.

Referring firstly to FIGS. 1, 2 and 3, a shield assembly comprises a base 1 provided with magnets 2. The base carries a ballistic bolster 3 provided with a concave ballistic fabric facia or front panel 4. At the opposite side of the bolster 3 there is provided a ballistic blanket shield 5. In FIG. 1 it is shown in a pre-deployment, rolled-up state, in which state it is secured to the bolster 3 by means of straps 6, only one of which is shown in FIGS. 1 and 3. Deployment of the shield as shown in FIG. 2 is accomplished by placing the assembly of FIG. 1 onto a car roof, wall, or even a hedge, releasing the straps 6 and then allowing the ballistic blanket roll to unroll into a generally vertical attitude. Naturally, where the assembly has to be placed onto a non-ferrous substrate, it will not be as well retained as it would be if the magnets were in use. However, in an emergency, the lack of retention may not be critical, since the primary protective function of the shield will still be achieved, albeit to a limited extent.

Figure 4:
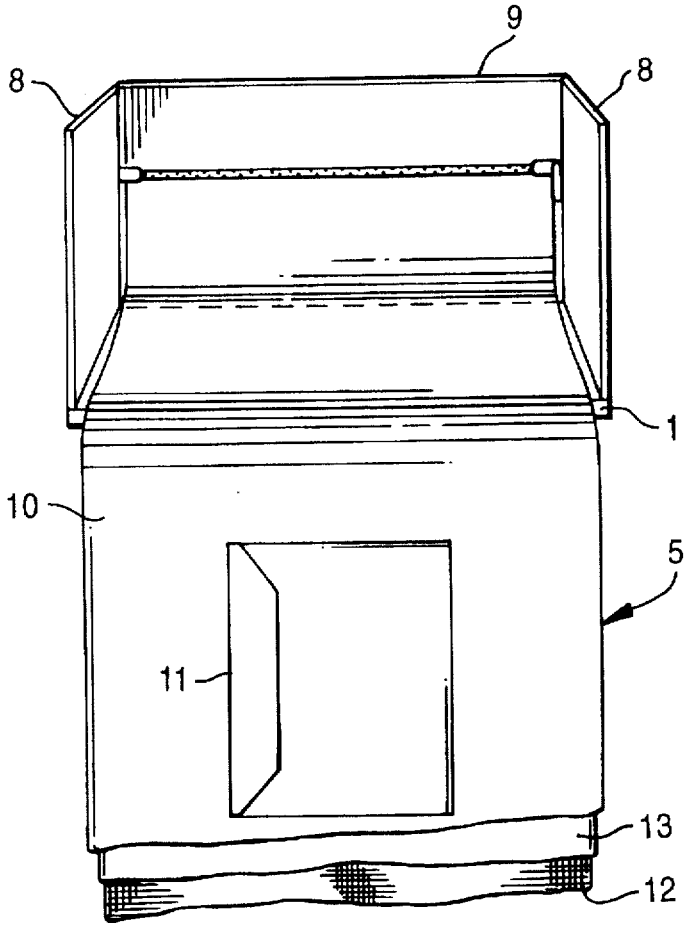
FIG. 4 is a diagrammatic view partly in section of another embodiment of the invention, shown in a deployed state.

FIG. 4 illustrates a particularly preferred embodiment, in which the base 1 also includes semi-rigid upstands or end walls 8, and the bolster 3 is replaced by a ballistic panel 9, optionally containing a ceramics reinforcement (not shown). The ballistics blanket shield 5 (shown deployed) is provided with a waterproof plastics jacket 10 provided with a pocket 11 into which a ceramic tile reinforcement (not shown) can be inserted for additional protection of a user's vital organs. The jacket 10 encloses the ballistic fabric proper, which is a multi-layer fabric 12 sealed inside a plastic envelope 13, in known manner. In this embodiment, the shield is not attached to an edge of the base 1, as in FIG. 1. It is attached by means of a zip fastener to the front wall 9, at a short distance above the base 1. The base 1, the wall 9 and the deployed shield 5 thus define between them a generally triangular section space (as seen from one end wall 8). This serves to trap ricochets which might penetrate the corner joint or seam between the base 1 and the front wall 9.

Figure 5:
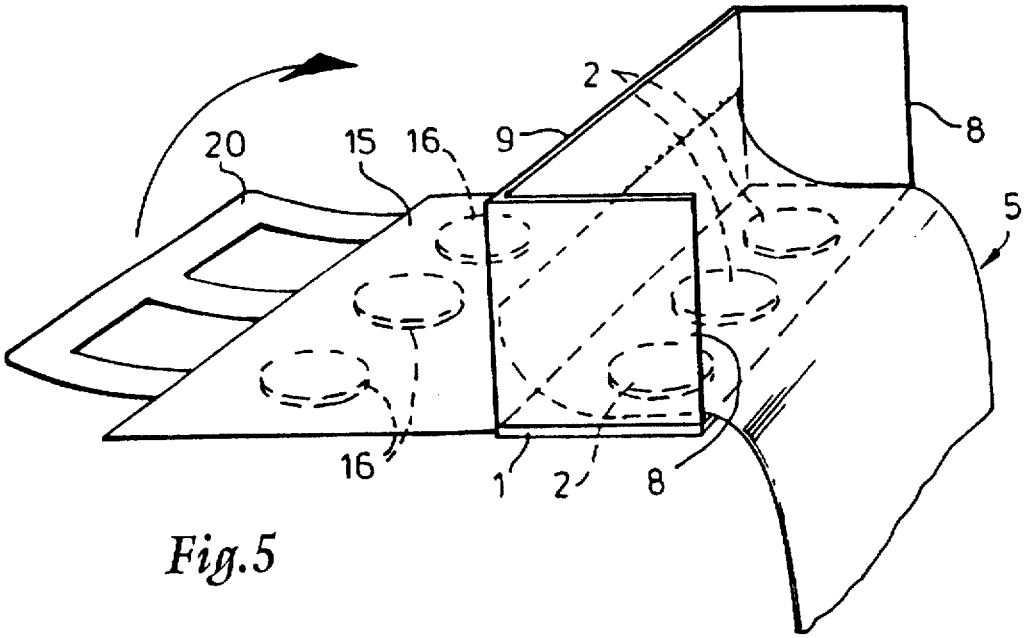
FIG. 5 is a diagrammatic view of a further embodiment of the invention.

FIG. 5 is a diagrammatic perspective view of the embodiment of FIG. 4, partly in section. In this view, the relationship between the end walls 8, the front wall 9 and the ballistic shield when fully deployed can be seen. It will be appreciated that the base 1 contains a plurality of magnets, (as in FIGS. 1–3), but in this embodiment, a fold over cover member 15 containing further magnets 16 is provided to confer enhanced adhesion to a ferrous substrate such as the vehicle roof shown diagrammatically in FIGS. 6 and 7 (discussed below).

Conveniently, the cover 15 includes quick release straps 20 for securing the entire assembly for ease of handling when not deployed. It will be appreciated that the combination of the base, the end walls, the front wall and the fold-over cover makes the rolled-up shield assembly readily portable; a shoulder strap (not shown) may be included to facilitate this.

Figure 6:
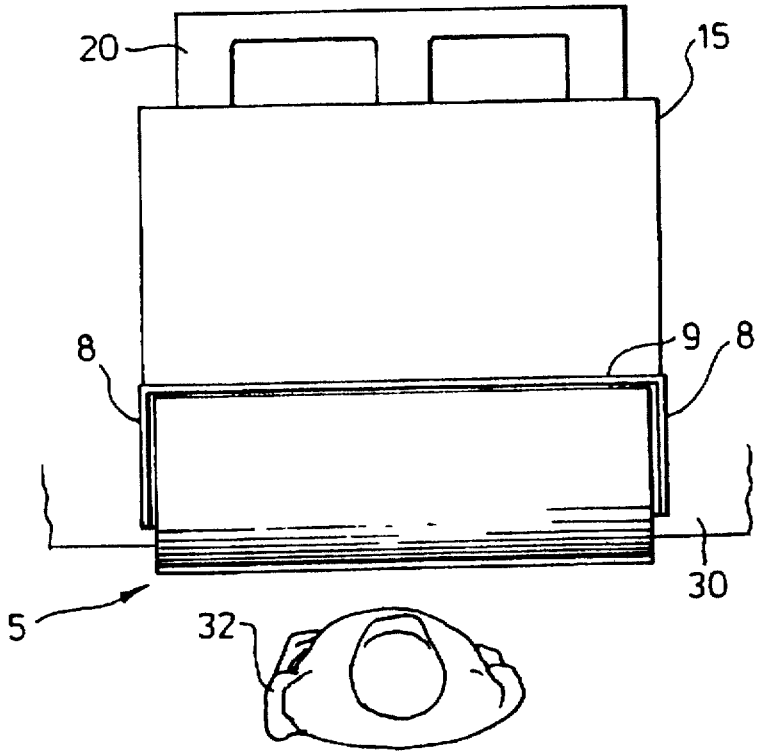
FIGS. 6 and 7 are respectively, a schematic plan view and side elevation of the shield of the earlier Figures, in place on the roof of a vehicle.
Figure 7:
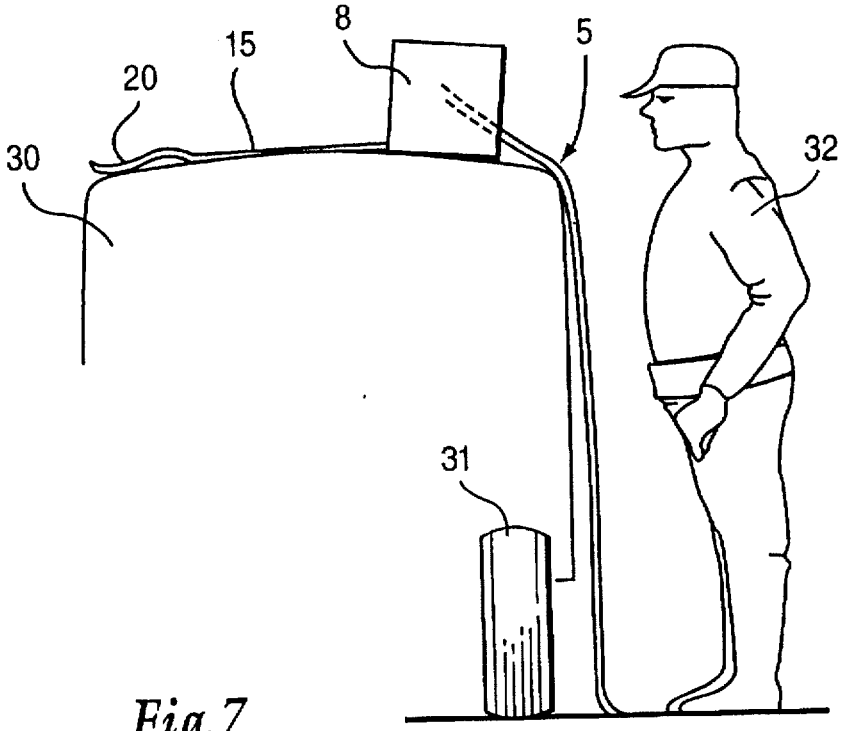

Finally, referring now to FIG. 6 and 7, typical operation of the shield of FIGS. 4 and 5 is illustrated. In FIGS. 6 and 7, the base 1 and the cover 15 are clamped by their internal magnets onto the roof of a vehicle 30, parts only of which are shown, including a tire 31 in FIG. 7. The shield 5 hangs down, to ground level and provides cover/protection for a person 32 standing at the side of the vehicle, it being assumed in this case that a perceived threat exists somewhere on the opposite side of the vehicle.

It will be appreciated that the embodiments shown are merely illustrative and that considerable modifications and alternate constructions are possible without departing from the scope of the invention. For example, the shield 5 may be unzipped from the front wall 9 and removed for use as a stretcher; side pockets for supporting poles could be provided for this and would have the additional advantage that only fairly minor further modifications would be needed to provide a portable shield useful in its own right.

I claim:

1. A portable ballistic shield comprising a roll of ballistic blanket material having at one end thereof a magnet for attaching it at least temporarily to a structure so that the blanket may be unrolled to form a free hanging screen.

2. A ballistic shield according to claim 1 further comprising an integral case for the roll, said case including the magnet for attaching the roll to the structure.

3. A ballistic shield according to claim 2 wherein said case includes a base, a pair of end walls and a front wall, a top and back wall being constituted by the roll of ballistic blanket material when not deployed.

4. A ballistic shield according to claim 1 further comprising quick release fastenings for the roll of ballistic blanket material whereby the ballistic shield can be positioned and the roll of ballistic blanket material unrolled with a minimum of delay.

5. A portable ballistic shield comprising a roll of ballistic blanket material having at one end thereof means for attaching said roll of blanket material at least temporarily to a structure so that the blanket may be unrolled to form a free handling screen; an integral case for the roll, said case including the means for attaching the roll to the structure, wherein said case includes a base, a pair of end walls and a front wall, a top and back wall being constituted by the roll of ballistic blanket material when not deployed; and further comprising a fold over cover adapted to enclose and secure the roll of blanket material when not deployed.

6. A ballistic shield according to claim 5 wherein said cover includes further means for attaching the roll at least temporarily to the structure.

* * * * *